US007583787B2

(12) United States Patent
Frey et al.

(10) Patent No.: US 7,583,787 B2
(45) Date of Patent: Sep. 1, 2009

(54) DEVICE FOR IMPROVING THE RESOLUTION CAPABILITY OF AN X-RAY OPTICAL APPARATUS

(75) Inventors: Albrecht Frey, Ofterdingen (DE); Norbert Pailer, Stetten (DE); Jess Koehler, Ottobrunn (DE)

(73) Assignee: Astrium GmbH, Munich (DE)

( * ) Notice: Subject to any disclaimer, the term of this patent is extended or adjusted under 35 U.S.C. 154(b) by 0 days.

(21) Appl. No.: 11/928,676

(22) Filed: Oct. 30, 2007

(65) Prior Publication Data

US 2008/0159472 A1 Jul. 3, 2008

(30) Foreign Application Priority Data

Oct. 31, 2006 (DE) ..... 10 2006 051 912

(51) Int. Cl.
*G21K 7/00* (2006.01)

(52) U.S. Cl. ..... 378/43; 378/145

(58) Field of Classification Search ..... 378/43, 378/145, 204, 205; 250/505.1
See application file for complete search history.

(56) References Cited

U.S. PATENT DOCUMENTS 5,027,377 A * 6/1991 Thoe ..... 378/145
7,406,151 B1 * 7/2008 Yun et al. ..... 378/43

FOREIGN PATENT DOCUMENTS

DE 101 39 384 A1 3/2003

OTHER PUBLICATIONS

English Language Abstract of DE 101 39 384 A1.
Ice, G. E., "Microbeam-Forming Methods for Synchrotron Radiation," *X-Ray Spectrometry*, vol. 26, Issue 6, p. 315-326, 1997 (online version dated Apr. 28, 1999).
Wolter, H., "Spiegelsysteme streifenden Einfalls als abbildende Optiken für Röntgenstrahlen," *Analen der Physik*, 10, 1952, p. 94-114.

* cited by examiner

*Primary Examiner*—Jurie Yun
(74) *Attorney, Agent, or Firm*—Greenblum & Bernstein, P.L.C.

(57) ABSTRACT

A device for improving resolution capability of an x-ray optical apparatus for an x-ray incident from a direction of incidence includes a mirror element including a mirror edge formed as a cylindrical shell section around an edge axis. The mirror element is spaced apart, in a radial direction, from a focal axis that is parallel to the direction of incidence. The edge axis is oriented at a first non-zero angle relative to the focal axis when viewed along a radial axis. The edge axis is oriented at a second non-zero angle relative to the focal axis.

22 Claims, 9 Drawing Sheets

DEVICE FOR IMPROVING THE RESOLUTION CAPABILITY OF AN X-RAY OPTICAL APPARATUS

CROSS-REFERENCE TO RELATED APPLICATIONS

The present application claims priority under 35 U.S.C. § 119 of German Patent Application No. 10 2006 051 912.4, filed Oct. 31, 2006, the disclosure of which is hereby expressly incorporated by reference herein in its entirety.

BACKGROUND OF THE INVENTION

1. Field of the Invention

The invention relates to a device for improving the spatial resolution of a micropore optics system for x-rays.

2. Discussion of Background Information

In the construction of a telescope for x-rays the problem arises that no suitable lenses exist for x-ray radiation because of the low refraction and the strong absorption in matter. Mirrors in the conventional sense cannot be used either, since the reflectivity for x-rays, unlike for visible light, is too low by far. Adequate reflectivity values result only for very large angles of incidence close to 90 degrees. This effect can be used to build a reflecting telescope for x-rays, provided that suitably designed surfaces are found. The x-rays must thereby strike the reflecting surface at a very small angle (e.g., grazing incidence), since x-rays are reflected by polished surfaces only when the incidence of the rays is almost grazing. One possibility for realizing an x-ray telescope is therefore to use a parabolic reflector. However, the parabolic reflector has very large image errors under the conditions of a grazing incidence.

A Wolter Type I telescope is known from the prior art (see, e.g., the publication "Spiegelsysteme streifenden Einfalls als abbildende Optiken für Röntgenstrahlen," H. Wolter, Analen der Physik, 10, 1952, p. 94-114). A telescope of this type utilizes the reflection of x-ray radiation with grazing incidence on metal surfaces. The basic concept is that a hyperboloid is placed behind the paraboloid as a correcting reflector, on which hyperboloid the x-rays are reflected for a second time.

The mirror arrangement of the Wolter Type I (e.g., Wolter-I) is composed of metallic (e.g., often comprising only coated foils) paraboloids of revolution multiply nested within one another, each of which is followed by a hyperboloid of revolution. These mirrors together have similar imaging properties like conventional telescopes in the visible range of light. The rays are first reflected on a small section of a parabolic reflector and subsequently on a section of a hyperbolic reflector. In order to achieve greater intensities, several mirror systems of this type were nested within one another, since, due to the grazing incidence, each pair of mirrors has only a very narrow range in which it can collect x-ray light and focus it in the focal point. For example, in the mirror system of the ROSAT x-ray satellite, four Wolter double mirrors with the same focal length are nested within one another in order to obtain a large collecting area.

An approximation of the Wolter-I optics is known from the prior art. The approximation uses several stacks of cylindrical areas with single tilt, which replaces the paraboloids and hyperboloids. This type of approximation can be tolerated if large focal lengths are chosen.

Furthermore, an x-ray lens has hitherto been produced by a pore optics system, the reflecting surfaces of which an ideal Wolter-I optics system approximates through two cylindrical areas. A pore optics system of this type is shown in FIGS. 1A and 1B. An approximation occurs for production-relevant reasons. In the pore optics system, the cylindrical mirror shells 12 are applied layer by layer on a cylindrical base 10, as shown in FIG. 1A (see FIG. 1B). A mirror shell is polished on the front face and provided on the back with many webs 14. The webs 14 of the mirror shell 12 last applied are connected to the mirror surface of the mirror shell 12 lying underneath, so that the last mirror surface is curved exactly like the one underneath it. This production method requires the spaces remaining between the webs 14 and the mirror shells 12, the pores, to have a rectangular cross section.

The advantage of a pore optics system is to be able to produce many mirror shells precisely and to mount them one behind the other. The mirror shells are connected to one another by webs, which leads to the geometry of many small pores. However, one disadvantage of the prior art is that the spatial resolution of the x-ray optics of known solutions no longer meets current requirements.

SUMMARY OF THE INVENTION

Embodiments of the present invention provide a device for an x-ray optics system that achieves an improved spatial resolution compared to the prior art.

According to aspects of the invention, there is a device for improving the resolution capability of an x-ray optical apparatus for an x-ray incident from a direction of incidence. In embodiments, the device comprises a mirror element with a mirror edge (e.g., slope, side, flank, etc.), the first mirror edge being formed by a first cylindrical shell section around an edge axis. The mirror element is arranged spaced apart with respect to a focal axis parallel to the direction of incidence by a focal point of the x-ray optical apparatus in a radial direction. The mirror element is arranged rotated about an axis extending in the radial direction with respect to the direction of incidence such that the edge axis is tilted with respect to the direction of incidence.

In implementations of the invention, an approximation of the parabolic and hyperbolic form can be achieved through a rotation of the mirror element about the radial axis an approximation of the parabolic and hyperbolic form can be achieved. According to aspects of the invention, this approximation is closer to the optimal form than is rendered possible by a simple approximation of cylindrical shells.

A device according to aspects of the invention has the advantage that it can lead to an improvement in the spatial resolution of an x-ray image, which can have a wide field of application with a broad use of x-ray optical devices. In other words, one advantage of a device according to aspects of the invention is that it results in less blurring of the image, which in turn leads to a better image quality. The desired reduction of the image blurring can be dependent on the stack length and the focal length. In implementations of the invention, the improvement in the resolution can be, for example, in the range of a factor of 3.

According to embodiments of the invention, a second mirror edge can be provided adjacent to the mirror edge, which second mirror edge is formed about a second edge axis by a second cylindrical shell section. The mirror element can be arranged such that a plane comprising the edge axis and second edge axis is tilted with respect to the direction of incidence. In this manner, the transition between the first and second mirror edge is better approximated, and the mirror edge the second mirror edge can be produced cost-effectively by cylinder approximation.

In accordance with aspects of the invention, in order to produce a mirror element that corresponds particularly well to the Wolter-I optics, the mirror edge can correspond to an approximation of a parabolic form and the second mirror edge to an approximation of a hyperbolic form.

In accordance with further aspects of the invention, in order for the mirror element to represent a particularly good approximation of the Wolter-I optics, the mirror element can have a width that is smaller than approximately a tenth of the radial distance of the mirror element regarding the focal axis. This can ensure that the approximation range does not become too large, so that the approximation does not become inadmissible.

According to embodiments of the invention, the mirror element can have a width that corresponds to an arc length of less than approximately two degrees in the radial direction. This range of the width of the mirror element provides a better approximation of the form of the Wolter-I optics, since the range to be approximated is very small compared to the entire parabolic and hyperbolic form of the Wolter-I optics. In this manner, the approximation does not cause any major errors.

According to embodiments of the invention, an incline between the edge axis and the direction of incidence can be in a range between approximately half a degree and approximately five degrees. In accordance with aspects of the invention, this provides a particularly good inclination range for improving the resolution capability of the x-ray optical apparatus.

In embodiments, in order to achieve a further improvement of the resolution capability of the x-ray optical apparatus, another mirror element with a third mirror edge and a fourth mirror edge adjacent to the third mirror edge can be provided. The third mirror edge is formed by a third cylindrical shell section around a third edge axis and the other mirror element is arranged spaced apart with respect to the focal axis in another radial direction. The other mirror element is furthermore arranged as being rotated about another axis extending in the other radial direction with respect to the direction of incidence, such that the third edge axis is tilted with respect to the direction of incidence. Through the provision of another mirror element of this type, an improvement of the yield of the incident x-rays can thus be achieved.

According to embodiments of the invention, the other mirror element can be adjacent to the mirror element and be arranged at a distance from the focal axis that corresponds to the spacing of the mirror element from the focal axis. Moreover, a lateral transition between the mirror element and the other mirror element can have a stepped offset. Through this tilted arrangement of the mirror elements, the area of the vertical expansion of the border line between the first and second mirror edge or the third and fourth mirror edge can be kept in a very narrow range. In this way, incident x-rays on both mirror elements can be deflected to a very small focal area or focal point. If the arrangement of the mirror elements were chosen such that the border lines between the first and the second mirror edge and the third and the fourth mirror edge touched, an arrangement of this type would not cause an optimal focusing on a joint focal point.

According to embodiments of the invention, it can be advantageous if a device according to aspects of the invention comprises a plurality of additional mirror elements that form a ring of mirror elements around the focal axis. This causes x-rays from a plurality of mirror elements to be deflected to a single focal range or focal point, which in turn increases the intensity of the light spot in the focal point. Accordingly, a better detection or evaluation capability of the incident x-rays is possible.

A device according to embodiments of the invention can also have an additional mirror element, which is arranged spaced apart from the focal axis in the radial direction. A spacing of the additional mirror element from the focal axis is larger than the spacing of the mirror element from the focal axis. In particular, a device of this type is advantageous when the additional mirror element has two mirror edges that are tilted with respect to one another so that an x-ray incident in the direction of incidence is reflected to an essentially identical focal point, like an x-ray that is deflected on the mirror element. An improvement of the resolution behavior can thus likewise be achieved by a nested arrangement.

In accordance with a first aspect of the invention, there is a device for improving resolution capability of an x-ray optical apparatus for an x-ray incident from a direction of incidence comprising a mirror element comprising a mirror edge formed as a cylindrical shell section around an edge axis. The mirror element is spaced apart, in a radial direction, from a focal axis that is parallel to the direction of incidence, the edge axis is oriented at a first non-zero angle relative to the focal axis when viewed along a radial axis, and the edge axis is oriented at a second non-zero angle relative to the focal axis.

The mirror element may further comprise a second mirror edge adjacent the mirror edge. The second mirror edge is formed as a second cylindrical shell section around a second edge axis, and a plane comprising the edge axis and the second edge axis is tilted with respect to the direction of incidence. Moreover, the mirror edge may correspond to an approximation of a hyperbolic form, while the second mirror edge corresponds to an approximation of a parabolic form.

A width of the mirror element may be smaller than approximately one tenth of a radial distance between the mirror element and the focal axis. Additionally, the width of the mirror element corresponds to an arc length of less than approximately two degrees in the radial direction. In embodiments, a magnitude of tilt between the edge axis and the direction of incidence is in a range of approximately one half a degree to approximately five degrees.

The device may also comprise another mirror element having a third mirror edge and a fourth mirror edge adjacent the third mirror edge. In embodiments, the third mirror edge is formed as a third cylindrical shell section around a third edge axis, and the other mirror element is spaced apart, in another radial direction, from the focal axis. Also, the third edge axis is oriented at the first non-zero angle relative to the focal axis when viewed along another radial axis extending in the other radial direction, and the third edge axis is oriented at the second non-zero angle relative to the focal axis.

The other mirror element may be adjacent the mirror element, while the mirror element and the other mirror element are spaced apart from the focal axis by a same distance. Furthermore, a transition between the mirror element and the other mirror element comprises a stepped offset. Even further, the device may include a plurality of additional mirror elements forming a ring around the focal axis.

The device may comprise an additional mirror element spaced apart from the focal axis in the radial direction. A spacing of the additional mirror element from the focal axis is larger than a spacing of the mirror element from the focal axis.

In embodiments, the mirror element is spaced apart, in the radial direction, from the focal axis that is parallel to the direction of incidence by a focal point of the x-ray optical apparatus.

According to another aspect of the invention, there is a device for improving resolution of an x-ray optical apparatus associated with an x-ray incident from a direction of incidence, the device comprising a mirror element having a first portion and a second portion adjacent the first portion. The first portion comprises a first cylindrical shell section formed around a first edge axis tilted at a first non-zero angle relative to a focal axis that is parallel to the direction of incidence. The second portion comprises a second cylindrical shell section formed around a second edge axis tilted at a second non-zero angle relative to the focal axis, the second non-zero angle being different from the first non-zero angle. The first edge axis and the second edge axis are oriented at a third non-zero angle relative to the focal axis when viewed along a radial axis in a radial direction.

In embodiments, a plane containing the first edge axis and the second edge axis is tilted at an offset angle relative to the focal axis. Moreover, the offset angle is in a range of approximately one half a degree to approximately five degrees, and a width of the mirror element is smaller than approximately one tenth of a radial distance between the mirror element and the focal axis.

The first portion may comprise an approximation of a hyperbolic form. The second portion may comprises an approximation of a parabolic form.

The device may also include another mirror element having a third portion and a fourth portion adjacent the third portion. The third portion comprises a third cylindrical shell section. The fourth portion comprises a fourth cylindrical shell section tilted relative to the third portion. The other mirror element is arranged in a stepped offset relative to the mirror element. The other mirror element is rotated about another radial axis that is perpendicular to the focal axis. The device may also include a plurality of additional mirror elements, wherein the mirror element, the other mirror element, and the plurality of additional mirror elements form a ring around the focal axis.

BRIEF DESCRIPTION OF THE DRAWINGS

Further advantages and application possibilities of the present invention are shown by the following description in conjunction with the exemplary embodiments shown in the drawings, in which.

DETAILED DESCRIPTION OF THE INVENTION

To explain the present invention more precisely, first the fundamental concepts are explained in more detail, which lead to a description of devices according to aspects of the invention. Absolute size data in the following description and the drawings are only exemplary data, and do not restrict the invention.

Figure 1A:
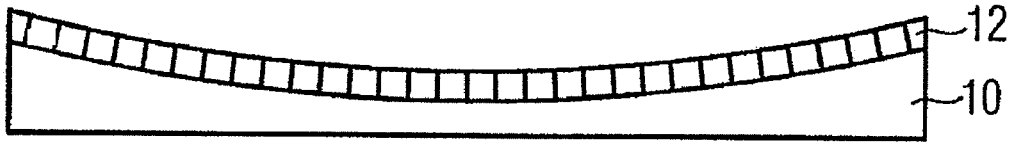
FIG 1A Prior Art
FIGS. 1A and 1B show representations of the structure of a pore optics system.
Figure 1B:
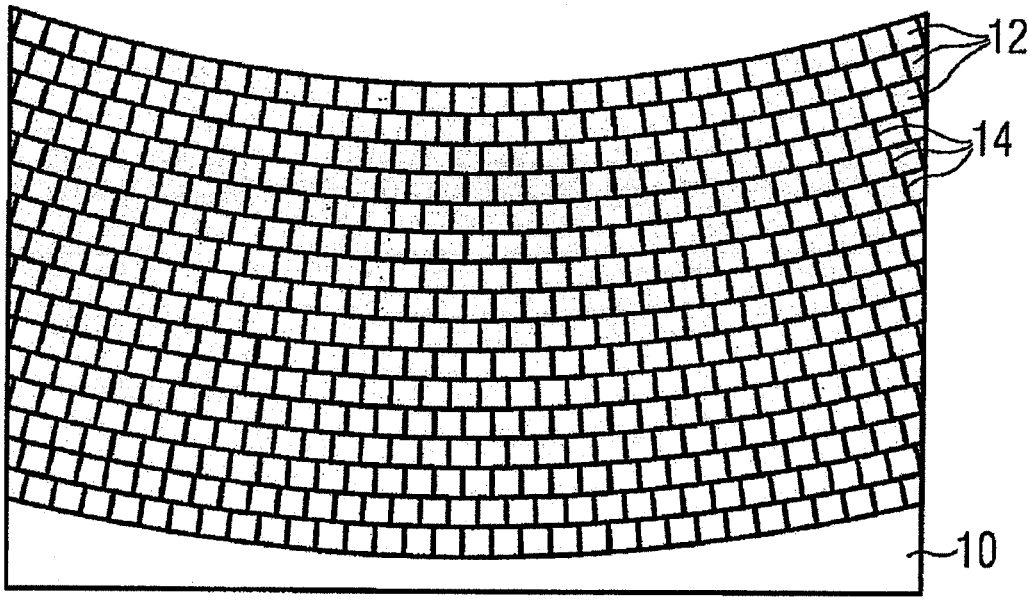
FIG 1B Prior Art
Figure 2:
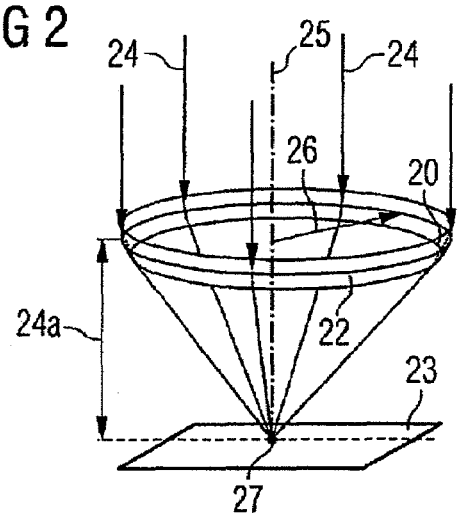
FIG 2 Prior Art
FIG. 2 shows a diagrammatic representation of two mirror shells one after the other according to the Wolter-I arrangement.

FIG. 2 depicts an approximation to the Wolter-I optics for x-ray astronomy. An x-ray telescope can comprise mirror shells 20, 22, which represent a so-called Wolter-I optics. Then the mirror shell 20 facing the object is a section of a paraboloid, and the mirror shell 22 facing the image plane is a section of a hyperboloid. Accordingly, the first mirror shell 20 would be the paraboloid section and the second mirror shell 22, the hyperboloid section, as shown in FIG. 2.

In order to always work in the range of the grazing incidence of x-rays 24, the sections of the paraboloid and of the hyperboloid are narrow mirror shells. They are usually arranged in a staggered manner, in order to image a greater quantity of light on the focal plane 23 at a distance 24*a* from the mirror shells 20, 22. It is customary to approximate the narrow shell-shaped sections of the paraboloid and of the hyperboloid through conical elements. In this case, the mirrors 20 and 22 represent ring-shaped sections of conical surfaces with a radius 26. The two cones forming the basis have a cone axis that is identical to the telescope symmetry axis (or focal axis 25). The included angles are selected such that the conical surfaces at the location of the mirror shells 20 and 22 fit against one another tangentially. In the exemplary embodiment, a conical approximation of a Wolter-I optics system is described by way of introduction.

One criterion for assessing the quality of the optical image is the diameter of the light spot 27 in the focal plane 23. A small spot 27 means that the resolution capability of the telescope is large, while with a large light spot 27 no distinction can be made between two objects lying close together. It is therefore the object of every optical telescope to generate the smallest possible light spot 27 in the focal plane 23.

Figure 3:
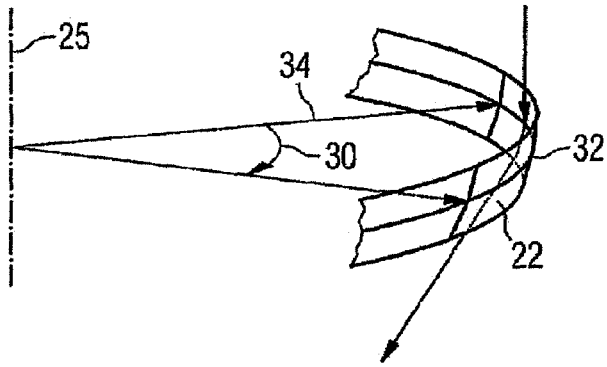
FIG 3 Prior Art
FIG. 3 shows a representation of cylinder segments of a mirror shell.

FIG. 3 depicts a cylinder approximation. Since the production of whole mirror shells 20, 22 is complex, it is expedient to undertake an azimuthal segmentation 30, as shown in FIG. 3. A mirror segment 32 of this type or a mirror edge can be described by approximation by a sectional surface of a cylinder. This greatly facilitates the production of the mirror shell segments. However, this approximation also leads to the diameter of the light spot in the focal plane being larger.

The cylinder approximation lies in adapting a cylinder surface to the conical surface that represents the paraboloid section. This is very successful, as long as the azimuthal segment size 30 is small compared to the radius of the shells 34, i.e., $b_{segment} << R_{shell}$ applies. The consequence of this approximation is that the light spot becomes larger in the focal plane.

Figure 4:
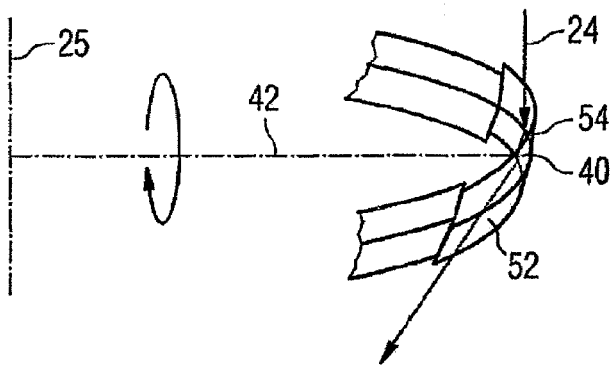
FIG. 4 shows a representation of an exemplary embodiment of the rotation of cylinder segments around the radial axis of the telescope arrangement.

FIG. 4 shows a cylinder approximation with rotated cylinder surfaces according to aspects of the invention. Embodiments of the invention employ a modification of the cylinder approximation, which makes it possible to substantially reduce the size of the light spot diameter with respect to the cylinder approximation. It is thus possible to achieve a light spot of the size of the conical approximation to the Wolter-I optics with cylinder shell sections. In this manner, the advantages of the easier production of cylinder shell segments have been effected without any significant loss of the resolution capability of the telescope.

According to exemplary embodiments, the modification lies in the cylinder segments 40 being rotated around the radial axis 42 of the mirror shell arrangement of the telescope, which runs through the center of the mirror shell segment. An arrangement of this type having rotation of the cylinder segments around the radial axis of the telescope arrangement is shown in FIG. 4. According to aspects of the invention, the diameter of the light spot in the focal plane can be reduced by a factor of three. In embodiments, the improvement is dependent on the distance of the mirror segment from the symmetry axis: it increases with smaller distance. Since exemplary embodiments relate to a tandem mirror of the periphery of the telescope, much smaller light spot diameters are achieved for the inner tandem mirror.

Figure 5A:
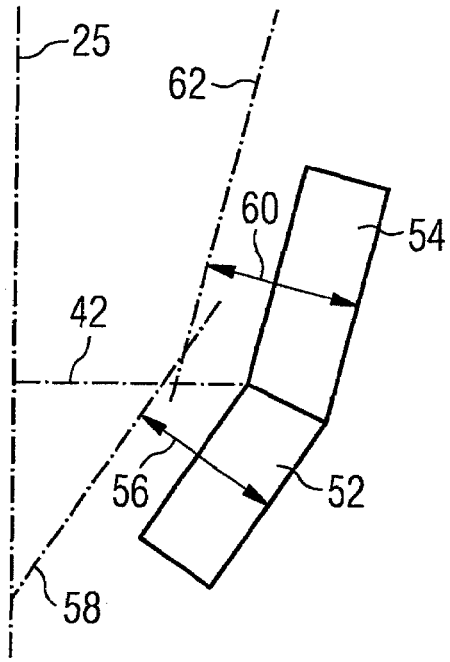
FIGS. 5A and 5B show representations of an exemplary embodiment of the present invention in two different sectional views.
Figure 5B:
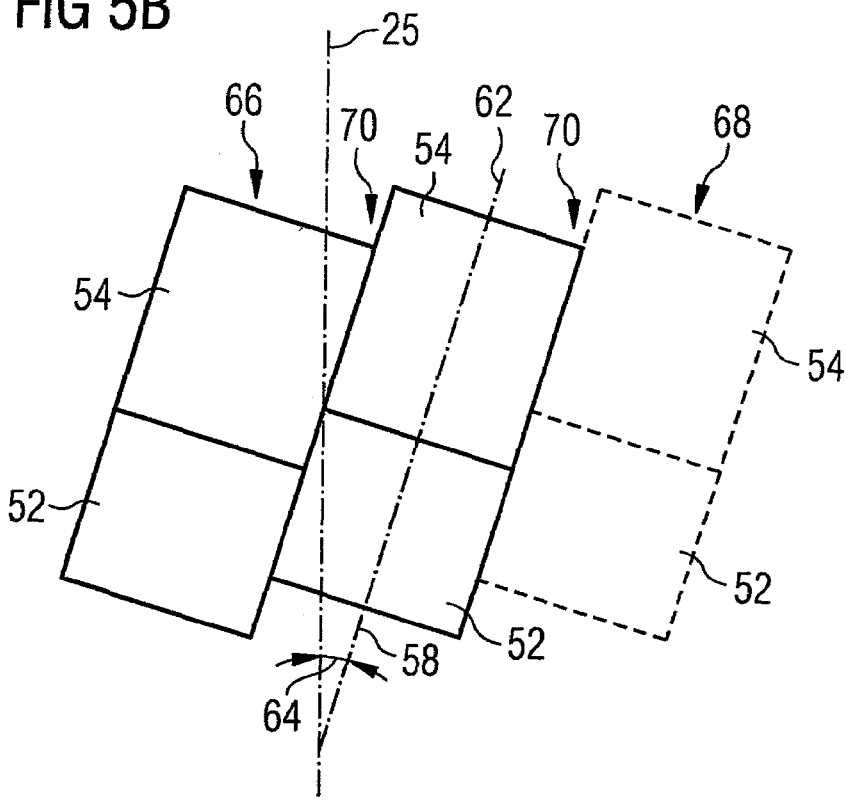

FIGS. 5A and 5B show an exemplary embodiment of the mirror element according to aspects of the invention in different sectional representations. FIG. 5A shows a cross-sectional representation of the exemplary embodiment of the mirror element according to aspects of the invention. In embodiments, the mirror element comprises a first mirror edge 52 and a second mirror edge 54, both of which are adjacent to one another. As used herein, the term "mirror edge" can also refer to a slope side, flank, etc. The first mirror edge 52 is arranged at a radial spacing 56 around a first edge axis 58. The first mirror edge 52 is formed from a cylinder segment or a cylinder surface section. The first edge axis 58 is tilted with respect to the focal axis 25. Furthermore, the second mirror edge 54 also comprises a cylinder surface section, which is arranged at a second radial spacing 60 around a second edge axis 62. The second edge axis 62 is tilted with respect to the first edge axis 58 so that the play element comprising the first mirror edge 52 and the second mirror edge 54 has a bent form. In embodiments, it can be ensured through this arrangement that x-rays that strike the mirror element at a direction of incidence parallel to the focal axis 25 are focused on a focal point (not shown in FIG. 5A).

FIG. 5B show a representation of the mirror element shown in FIG. 5A looking along axis 42, along with other mirror elements arranged adjacent thereto. FIG. 5B also shows the focal axis 25 as well as the first edge axis 58 and the second edge axis 62. The first and second mirror edge 52 or 54 of the individual mirror elements are cylinder surface sections, as described in connection with FIG. 5A. Furthermore, FIG. 5B shows, according to aspects of the invention, a rotation of the mirror element in which the mirror element is turned around a radial axis (not shown here) arranged at right angles to the focal axis 25. In this manner, an offset angle 64 is formed between the focal axis 25 under the first or second edge axis 58 or 62. According to aspects of the invention, improvement in the optical resolution can be achieved through this offset angle 64.

Furthermore, adjacent mirror elements, such as those shown by reference numbers 66 and 68 in FIG. 5B, can also be arranged in a stepped offset 70 so that the structure shown in FIG. 5B results. In embodiments, a limit between the first mirror edge 52 and the second mirror edge 54 lies as far as possible in a narrow lateral range so that a focusing of light rays or x-rays from different mirror elements are all focused as far as possible on a small focal point. Also, through utilizing the structure shown in FIG. 5B, a ring shape can be formed around the focal axis 25, as shown, e.g., in FIG. 2. A shape of this type is indicated to some extent in FIG. 4.

According to aspects of the invention, an improvement in the focusing of an x-ray is achieved in that a better approximation of the Wolter-I optics is achieved through the offset angle 64 compared to when the boundary line between one of the first mirror edge 52 and the second mirror edge 54 is horizontal (i.e., at right angles to the focal axis 25).

A specific exemplary embodiment of the present invention compared to a conical as well as a simple cylinder approximation is described in more detail below with respect to FIGS. 6-13.

A model of the conical approximation of the Wolter-I optics and the unmodified and modified cylinder approximation (i.e., of an exemplary embodiment of the present invention) of the conical approximation of the Wolter-I optics was produced with the aid of the "ASAP" optics program. With the aid of geometrical-optical ray-tracing calculations, the light spot was calculated in the focal plane of the arrangement (spot diagram). The geometry parameters are as follows: a distance between mirror shells and focal plane is given by f=50000 mm, and a radius of the mirror shell boundary is given by R=3500 mm.

Figure 6:
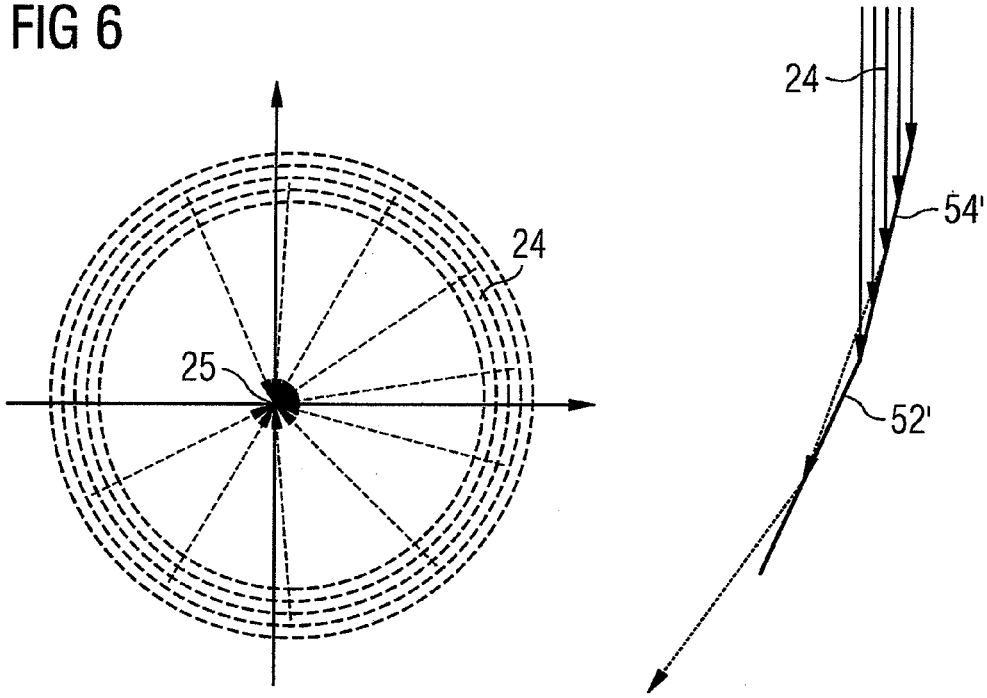
FIG. 6 shows a representation of the deflection of light rays at the telescope.
Figure 7:
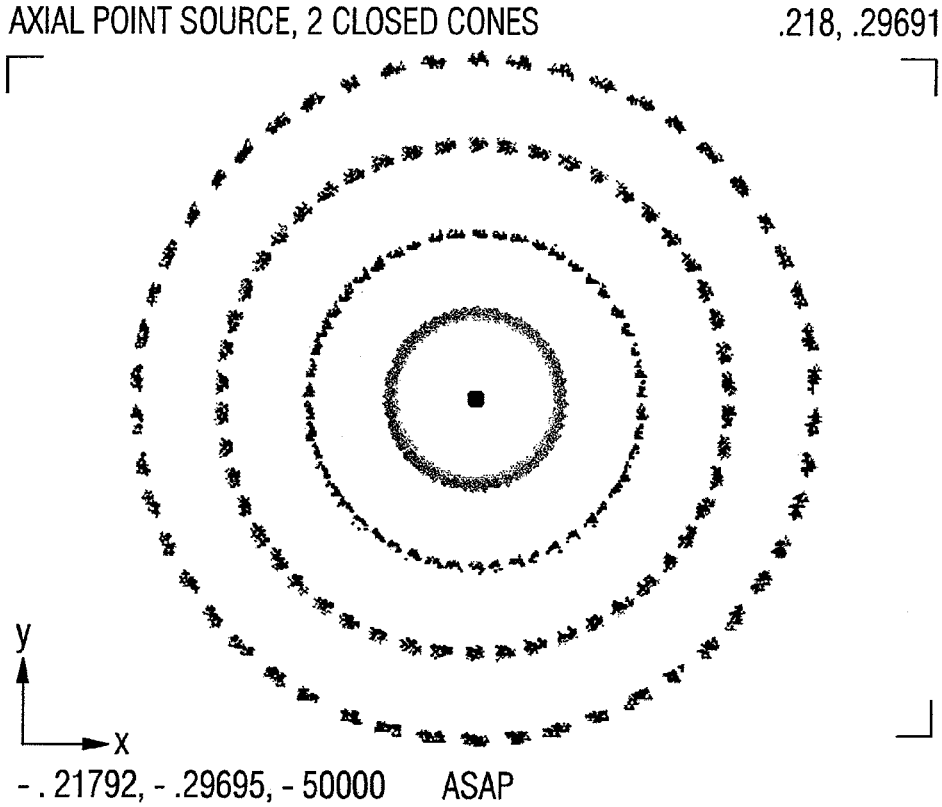
FIG. 7 shows a spot diagram in the focal plane, conical mirror shells being used to generate the spot diagram.

FIGS. 6 and 7 depict an example of conical approximation of the Wolter-I optics. For the light source, light rays 24 (especially x-rays) fall parallel to the symmetry axis 25 of the telescope on the annular arrangement of a tandem mirror 40, which is composed of the mirror shell that represents the conical approximation of the paraboloid and the second mirror shell that represents the conical approximation of the hyperboloid. The grid of the light rays is indicated in FIG. 6, the left part of the image showing a top plan representation and the right part of the image showing a front view representation of a telescope of this type.

Regarding the light spot in the focal plane, a rotationally symmetrical light spot results in the center of the focal plane, the diameter of which light spot is approximately 0.6 mm. This is shown by the dimensions of the diagram shown in FIG. 7, which represents the impact points of the rays in the focal plane. As can be expected, the symmetry is maintained and the image points of the individual rays lie on circles. The consequence of a shift of the focal plane along the telescope axis is that the light spot becomes larger, irrespective of the shift direction. This shows that in fact the focal plane is present. FIG. 7 thereby shows a spot diagram in the focal plane. The two conical mirror shells are illuminated with axial light rays. The spot diameter is 0.42 mm.

Figure 8:
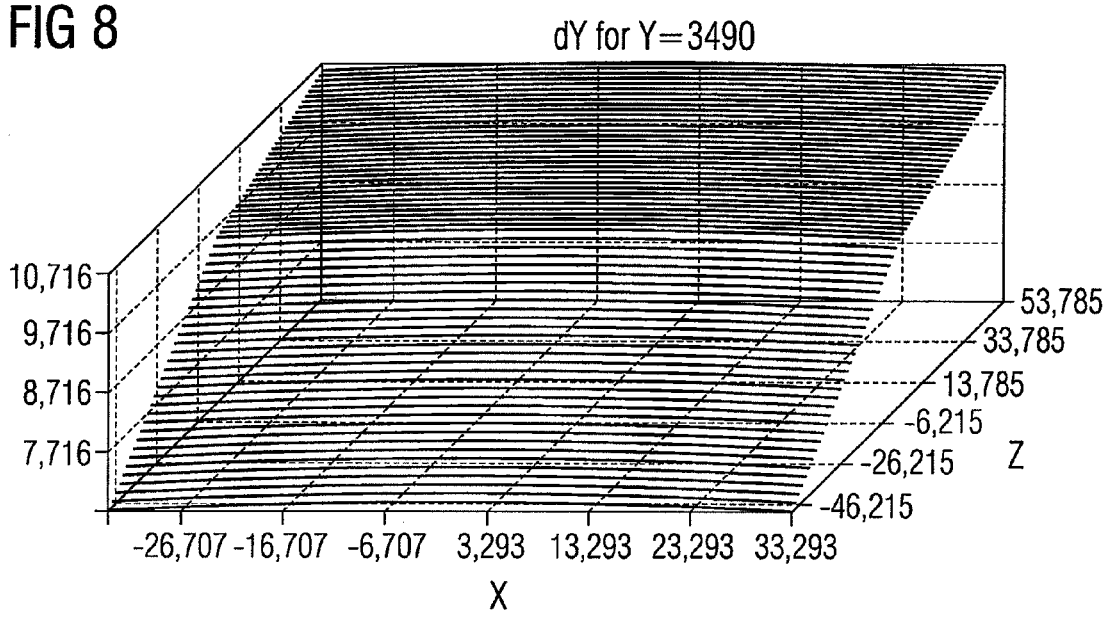
FIG. 8 shows a diagram of the deviation when using a mirror element of two cylinder surfaces.

FIGS. 8-11 depict an example of a cylinder approximation without rotated surfaces. An azimuthal segment corresponds, for example, to a 360th of an arc, that is, one degree. For a circular radius of 3500 mm, this result in an arc length of $b=(2\pi/360)$ 1 deg 3500 mm=61 mm. One cylinder surface respectively has been adapted to the conical surfaces 52' and 54', which correspond to the mirror surfaces 52 and 54. This is possible, because the arc length is much smaller than the circular radius. FIG. 8 shows an image of a tandem of this type of two cylinder surfaces.

Figure 9A:
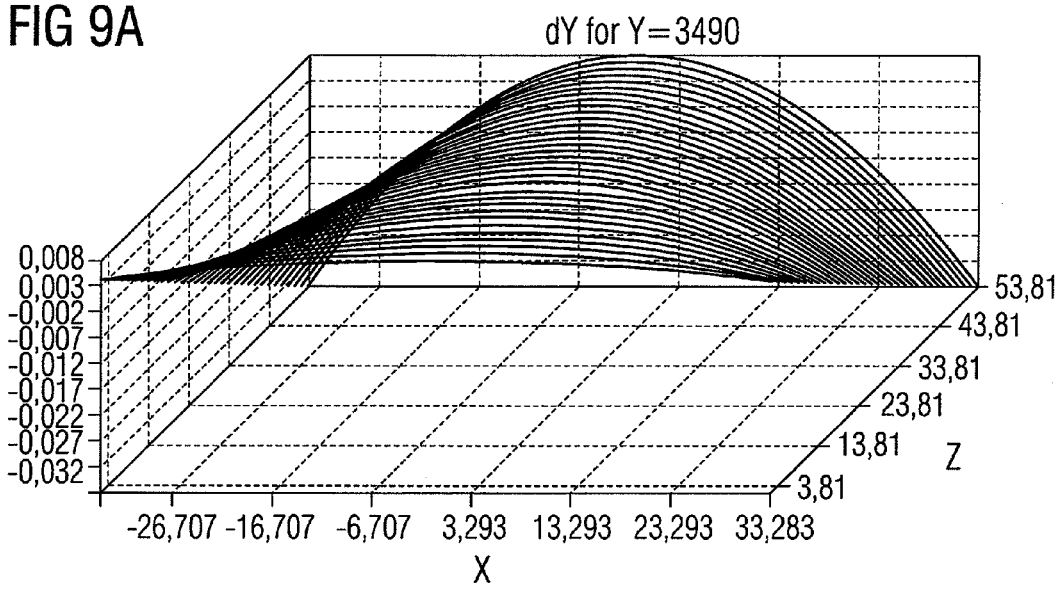
FIGS. 9A and 9B show diagrams of the deviation of the cylinder approximation of a conical surface for a paraboloid (FIG. 9A) or a hyperboloid (FIG. 9B)
Figure 9B:
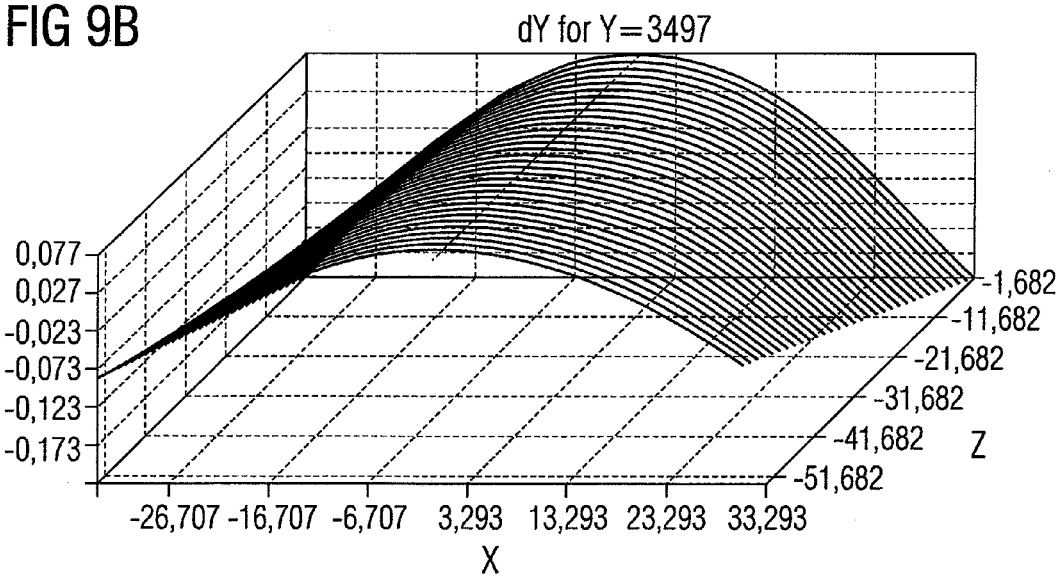
Figure 10:
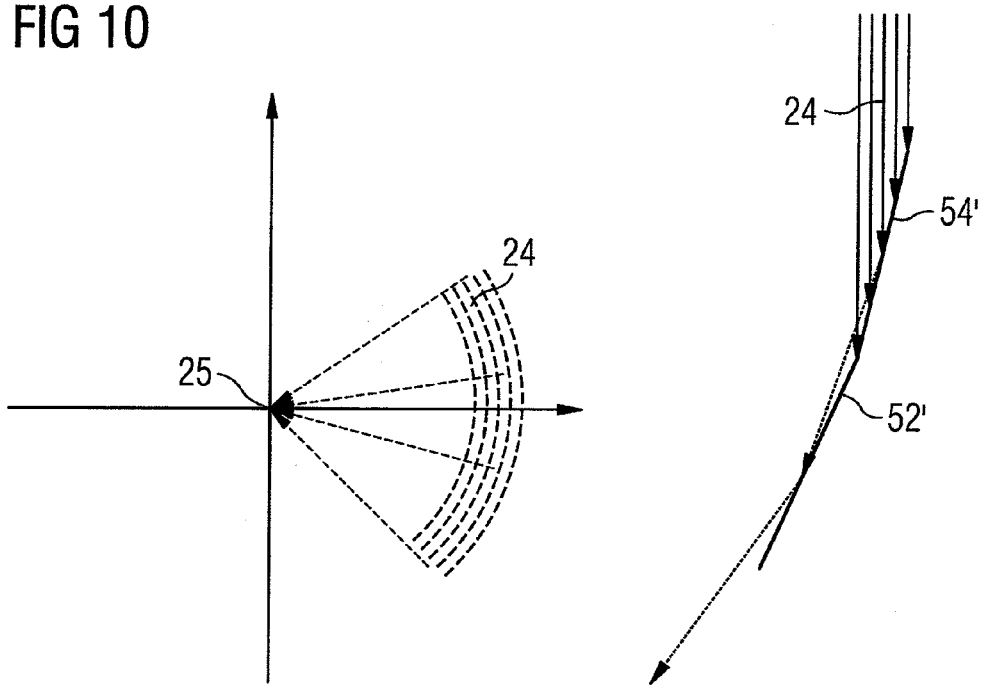
FIG. 10 shows a representation of the illumination of the mirror element of two cylindrical shells.

In this example, the deviation of the cylinder surfaces from the conical surfaces is always less than one micrometer. FIG. 9A shows that the difference in the case of the mirror surface 52' (corresponding to the mirror edge 52) is less than 10 nm. FIG. 9B shows the case of the mirror surface 54' (corresponding to mirror edge 54) in which the difference is less than 200 nm. Thus, in FIG. 9A the deviation from the conical approximation is shown as the difference between the cylinder approximation of the conical surface that describes the paraboloid of the Wolter-I optics. In FIG. 9B, the deviation from the conical approximation is shown as the difference between the cylinder approximation of the conical surface that describes the hyperboloids of the Wolter-I optics. The y-axis gives the deviation in micrometers.

For the light source, the tandem of cylinder mirrors 52', 54' is illuminated with light rays 24. The light rays 24 run parallel to the telescope axis 25, their spatial arrangement being shown in FIG. 10, in which the illumination of the tandem is shown from two cylinder shells 52' and 54'. The arc section is shown in an exaggerated manner; the azimuth angle being in actuality approximately 1 degree.

Figure 11:
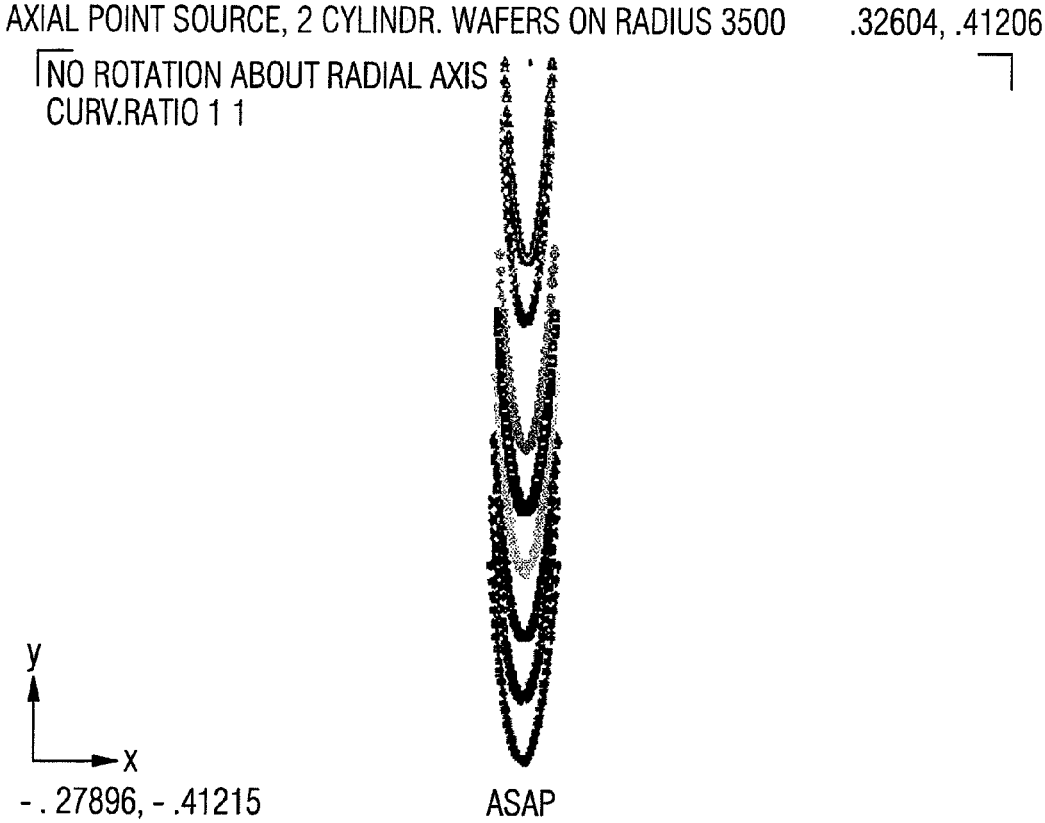
FIG. 11 shows a spot diagram in the focal plane, which is generated by a mirror element with cylinder surfaces.

Regarding the light spot in the focal plane, a cylinder tandem mirror generates a light spot in the center of the focal plane, which light spot is unsymmetrical. Its maximum extension lies in the direction perpendicular to the tandem mirror and is approximately 0.82 mm, as can be seen from the spot diagram from FIG. 11. In this example, an arrangement of several cylinder tandem mirrors such that a complete ring of mirror shells was produced, resulting in a round light spot in the center of the focal plane, the diameter of which light spot is approximately 0.82 mm. FIG. 11 shows a spot diagram in the focal plane which generates a tandem from two described cylinder surfaces from the axially incident light rays. The spot diameter is 0.82 mm.

Figure 12A:
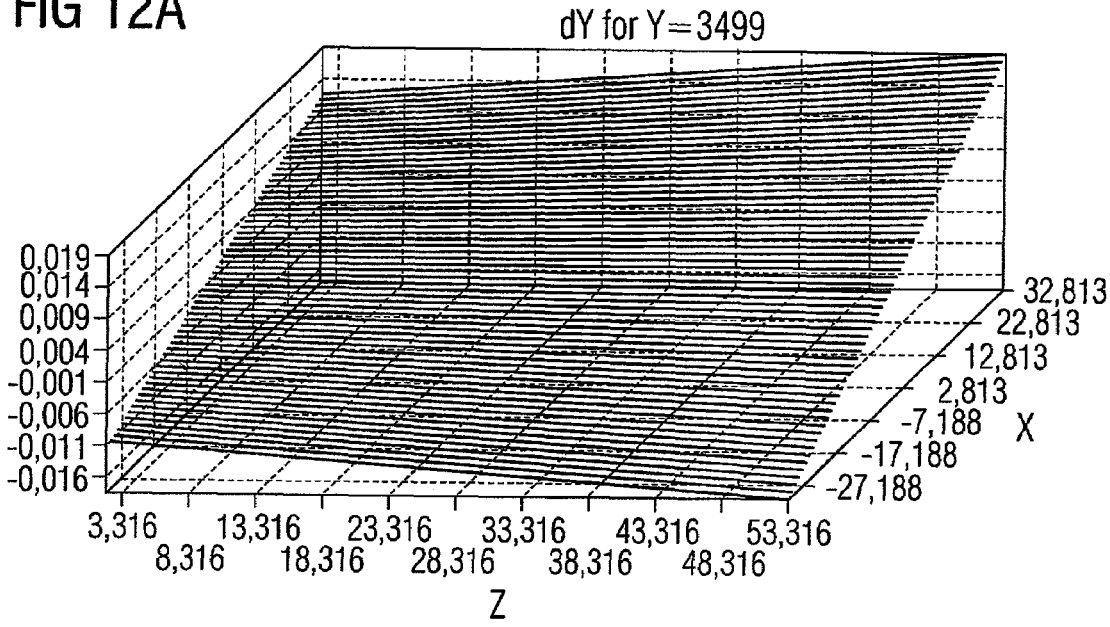
FIGS. 12A and 12B show diagrams of the deviation of an exemplary embodiment of the present invention from an unmodified cylinder approximation for the first mirror edge (FIG. 12A) and the second mirror edge (FIG. 12B)
Figure 12B:
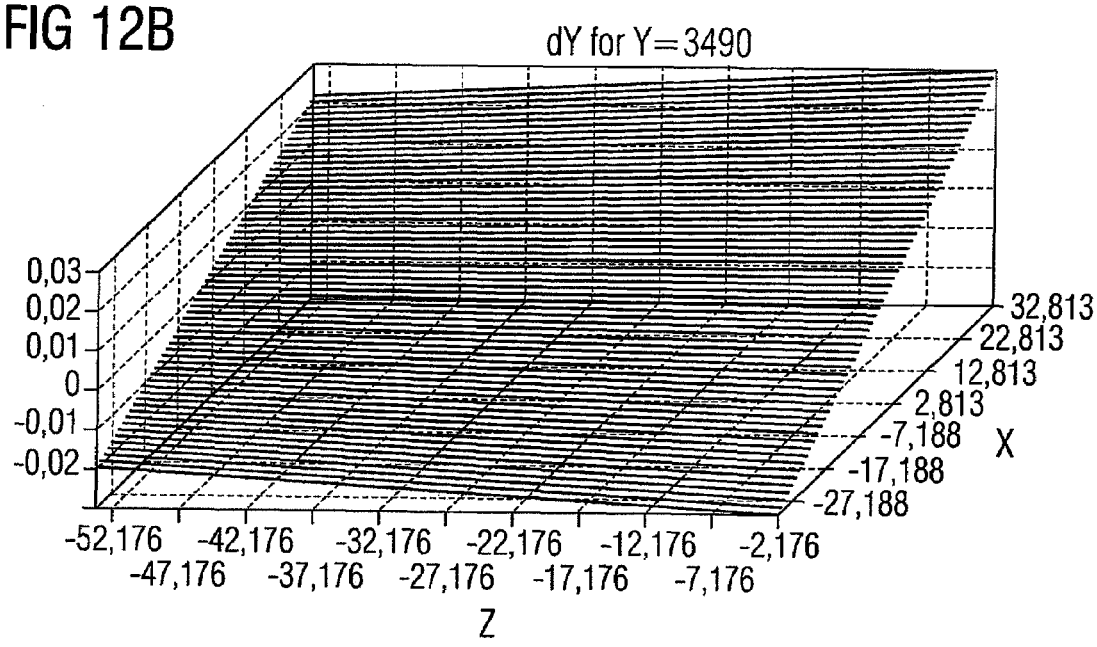
Figure 13:
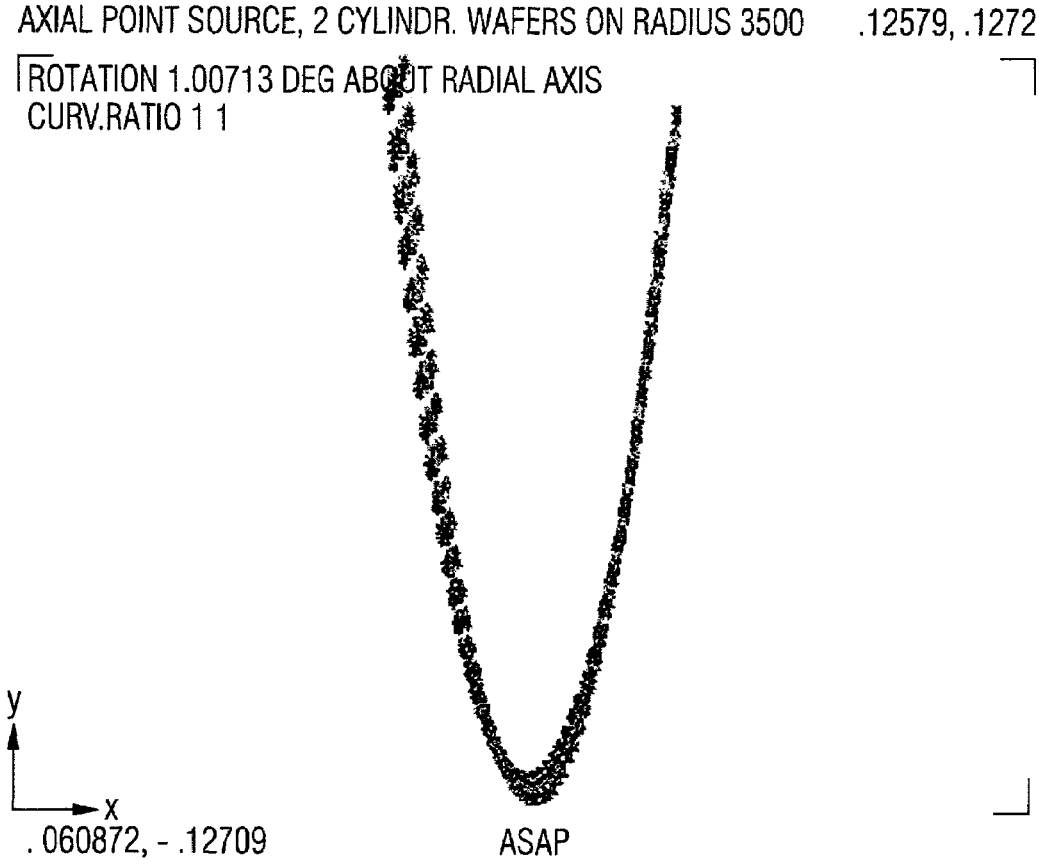
FIG. 13 shows a spot diagram in the focal plane that is obtained through a mirror element according to an exemplary embodiment of the present invention.

FIGS. 12A, 12B, and 13 depict an example of a cylinder approximation with rotated cylinder surfaces according to aspects of the invention. In the example, the surfaces of the modified (i.e., rotated according to the invention) and unmodified cylinder approximation of the mirror surface (i.e., 52 or 52') differ by less than 40 micrometers; while the surfaces of the modified and unmodified cylinder approximation of the mirror surface (i.e., 54 and 54') differ by less than 60 micrometers. Although these are small numbers compared to the lateral dimensions of the mirror surfaces, they still represent significant deviations, if one considers that the difference between cylinder and conical approximation is smaller by three orders of magnitude. FIG. 12A shows the deviation of the modified (rotated) and unmodified cylinder approximation for the mirror surface 52 or 52', while FIG. 12B shows the deviation of the modified (rotated) and unmodified cylinder approximation for the mirror surface 2 of the tandem mirror.

In the example of FIGS. 12A, 12B, and 13, the same light source is used as was used in the example of FIGS. 8-11 in order to have a direct comparison.

In the example of FIGS. 12A, 12B, and 13, the diameter of the light spot in the focal plane is substantially reduced by rotating the tandem of the two cylinder mirrors 52 and 54 around the radial axis of the telescope arrangement by 1.00713 degrees. As shown in FIG. 13, the maximum extension of the light spot is approximately 0.25 mm. In this example, an arrangement of several cylinder tandem mirrors forming a complete ring of mirror shells is produced, resulting in a round light spot in the center of the focal plane, the diameter of which light spot is approximately 0.25 mm. That is smaller by approximately a factor of 3.3 compared the case of the unmodified cylinder approximation (e.g., FIGS. 8-11), and smaller by approximately a factor of 2.4 than in the case of the conical approximation of the Wolter-I optics (e.g., FIGS. 6-7).

FIG. 13 shows a spot diagram in the focal plane that generates a tandem of two rotated cylinder surfaces from the axially incident light rays. The spot diameter is 0.25 mm.

| Reference Numbers | |
|---|---|
| 10 | Base |
| 12 | Cylindrical mirror shells |
| 14 | Webs |
| 20, 22 | Mirror shells |
| 23 | Focal plane |
| 24 | Light rays, x-rays |
| 24a | Spacing between the focal plane and the mirror shells |
| 25 | Focal axis, telescope axis |
| 26 | Radius of the mirror shells |
| 27 | Light spot |
| 30 | Azimuthal segmentation |
| 32 | Mirror segment |
| 34 | Radius of the shells of the cylinder approximation |
| 40 | Cylinder segment |
| 42 | Radial axis |
| 52 | First mirror edge |
| 54 | Second mirror edge |
| 56 | Radial spacing from the first mirror edge to the first edge axis 58 |
| 58 | First edge axis |
| 60 | Radial spacing from the second mirror edge to the second edge axis 62 |
| 62 | Second edge axis |
| 64 | Offset angle |
| 66, 68 | Further mirror elements |
| 70 | Stepped offset |

The invention claimed is:

1. A device for improving resolution capability of an x-ray optical apparatus for an x-ray incident from a direction of incidence, comprising:

a mirror element comprising a mirror edge formed as a cylindrical shell section around an edge axis, wherein the mirror element is spaced apart, in a radial direction, from a focal axis that is parallel to the direction of incidence, the edge axis is oriented at a first non-zero angle relative to the focal axis when viewed along a radial axis, and the edge axis is oriented at a second non-zero angle relative to the focal axis.

2. The device of claim 1, wherein:

the mirror element further comprises a second mirror edge adjacent the mirror edge, the second mirror edge is formed as a second cylindrical shell section around a second edge axis, and a plane comprising the edge axis and the second edge axis is tilted with respect to the direction of incidence.

3. The device of claim 2, wherein:

the mirror edge corresponds to an approximation of a hyperbolic form, and the second mirror edge corresponds to an approximation of a parabolic form.

4. The device of claim 2, further comprising another mirror element having a third mirror edge and a fourth mirror edge adjacent the third mirror edge.

5. The device of claim 4, wherein:

the third mirror edge is formed as a third cylindrical shell section around a third edge axis, the other mirror element is spaced apart, in another radial direction, from the focal axis, the third edge axis is oriented at the first non-zero angle relative to the focal axis when viewed along another radial axis extending in the other radial direction, and the third edge axis is oriented at the second non-zero angle relative to the focal axis.

6. The device of claim 5, wherein:

the other mirror element is adjacent the mirror element, and the mirror element and the other mirror element are spaced apart from the focal axis by a same distance.

7. The device of claim 6, wherein a transition between the mirror element and the other mirror element comprises a stepped offset.

8. The device of claim 4, further comprising a plurality of additional mirror elements forming a ring around the focal axis.

9. The device of claim 1, wherein a width of the mirror element is smaller than approximately one tenth of a radial distance between the mirror element and the focal axis.

10. The device of claim 9, wherein the width of the mirror element corresponds to an arc length of less than approximately two degrees in the radial direction.

11. The device of claim 1, wherein a magnitude of tilt between the edge axis and the direction of incidence is in a range of approximately one half a degree to approximately five degrees.

12. The device of claim 1, further comprising an additional mirror element spaced apart from the focal axis in the radial direction.

13. The device of claim 12, wherein a spacing of the additional mirror element from the focal axis is larger than a spacing of the mirror element from the focal axis.

14. The device of claim 1, wherein the mirror element is spaced apart, in the radial direction, from the focal axis of a focal point of the x-ray optical apparatus.

15. The device of claim 1, wherein when viewed along the radial axis:

the mirror edge is arranged in a rotated position that is rotated about the radial axis relative to a reference position, in the reference position the edge axis is parallel to the focal axis, and in the rotated position the edge axis is rotated relative to the focal axis by the first non-zero angle.

16. A device for improving resolution of an x-ray optical apparatus associated with an x-ray incident from a direction of incidence, comprising:

a mirror element having a first portion and a second portion adjacent the first portion, wherein the first portion comprises a first cylindrical shell section formed around a first edge axis tilted at a first non-zero angle relative to a focal axis that is parallel to the direction of incidence, the second portion comprises a second cylindrical shell section formed around a second edge axis tilted at a second non-zero angle relative to the focal axis, the second non-zero angle being different from the first non-zero angle, and the first edge axis and the second edge axis are oriented at a third non-zero angle relative to the focal axis when viewed along a radial axis in a radial direction.

17. The device of claim 16, wherein a plane containing the first edge axis and the second edge axis is tilted at an offset angle relative to the focal axis.

18. The device of claim 17, wherein:

the offset angle is in a range of approximately one half a degree to approximately five degrees, and a width of the mirror element is smaller than approximately one tenth of a radial distance between the mirror element and the focal axis.

19. The device of claim 16, wherein:

the first portion comprises an approximation of a hyperbolic form, and the second portion comprises an approximation of a parabolic form.

20. The device of claim 16, further comprising another mirror element having a third portion and a fourth portion adjacent the third portion, wherein the third portion comprises a third cylindrical shell section, the fourth portion comprises a fourth cylindrical shell section tilted relative to the third portion, the other mirror element is arranged in a stepped offset relative to the mirror element, and the other mirror element is rotated about another radial axis that is perpendicular to the focal axis.

21. The device of claim 20, further comprising a plurality of additional mirror elements, wherein the mirror element, the other mirror element, and the plurality of additional mirror elements form a ring around the focal axis.

22. The device of claim 16, wherein when viewed along the radial axis:

the first cylindrical shell section is arranged in a rotated position that is rotated about the radial axis relative to a reference position, in the reference position the first edge axis is parallel to the focal axis, and in the rotated position the first edge axis is rotated relative to the focal axis by the third non-zero angle.

* * * * *